United States Patent [19]

Wolfla et al.

[11] 3,971,633

[45] July 27, 1976

[54] TWO LAYER COATING SYSTEM

[75] Inventors: Thomas A. Wolfla; Robert C. Tucker, Jr., both of Indianapolis, Ind.

[73] Assignee: Union Carbide Corporation, New York, N.Y.

[22] Filed: Feb. 10, 1975

[21] Appl. No.: 548,661

[52] U.S. Cl. ..... 29/195; 29/196.6

[51] Int. Cl.[2] ..... B32B 15/04

[58] Field of Search ..... 29/195 A, 196.6; 427/34, 422, 427

[56] References Cited

UNITED STATES PATENTS

| | | | |
|---|---|---|---|
| 2,048,276 | 7/1936 | Marlies et al. | 29/195 |
| 3,556,747 | 1/1971 | Hyde et al. | 29/198 |
| 3,606,359 | 9/1971 | McCormick | 277/224 |

*Primary Examiner*—L. Dewayne Rutledge
*Assistant Examiner*—E. L. Weise
*Attorney, Agent, or Firm*—Dominic J. Terminello

[57] ABSTRACT

A coating system for protecting metallic substrates in reducing or oxygen-free environments which includes a first layer of chromium carbide plus metallic binder having a thickness of from 0.001 to 0.015 inches and a surface layer of all chromium carbide having a thickness of from 0.0005 to 0.005 inches.

8 Claims, No Drawings

TWO LAYER COATING SYSTEM

This invention relates to a coating system for protecting metallic substrates in reducing and oxygen-free environments. More particularly this invention relates to a coating system for protecting metallic components in sodium or helium cooled nuclear reactors.

Nuclear reactors contain components in which metallic surfaces are designed to move relative to each other. Due to the friction between metallic surfaces, the forces required to initiate and sustain movement can be quite large. Metallic mechanisms in nuclear reactors which use liquid sodium as the working heat transfer fluid are particularly plagued with high frictional forces due to the presence of this aggressive, high temperature corrosive medium.

Metallic surfaces immersed in sodium at elevated temperature are stripped by dissolution or reduction of any oxide films which are normally present on virtually all metals. These films, present in most other environments, reduce friction and prevent diffusion bonding by separating the elemental metallic surfaces. It is well known that ceramic materials such as oxide films have low self-mating friction coefficients and do not diffusion bond except at extremely high temperatures and/or pressures because of the highly directional ionic bonding of ceramics. Other films may be hydrates of oxides or absorbed molecules of gaseous species, but again the bonding, predominantly polar in these cases, is highly directional and resists diffusion bonding.

The virtually atomically clean metal surfaces in sodium will, however, rapidly diffusion bond or self-weld together at any point of contact because metallic bonding is not highly oriented or directional and "diffusional" bonding across perfectly clean interfaces is uninhibited. It is quite apparent, therefore, that any metal-to-metal contacts must be prevented if relative motion between these surfaces is required in such an environment.

Accordingly, it is the main object of this invention to provide a coating system for metallic substrates used in a reducing or oxygen-free environments which system will prevent self welding of the mating metallic surfaces while exhibiting good wear and thermal shock properties.

The most practical method of preventing metal-to-metal contact is to coat the surfaces with materials which resist diffusion bonding and have low coefficients of friction. It is also obvious that these coatings must be effectively insoluble in sodium and not react with sodium to form other compounds, nor can the coating be degraded by reaction with the metal substrate. Moreover, they must be wear resistant if any extensive amount of motion is anticipated. Since they must endure a number of cycles from room temperature to operatng temperatures as well as thermal variations during operation, they must be thermal shock resistant. Obviously, if they are used in the reactor core they must also withstand irradiation.

Some ceramic materials would be likely candidates for this type coating because they resist self-welding. Unfortunately, most ceramic materials have poor thermal shock resistance, particularly when applied as a coating on a metal. The thermal shock resistance of a coating system (coating plus substrate) is a function of the individual and relative coefficients of thermal expansion of the components as well as their heat capacities, thermal conductivity, and mechanical properties. The coefficients of thermal expansion of ceramics are much lower than metals, thus on heating metallic components coated with a ceramic, a stress higher than the mechanical strength of the coating can easily be achieved causing cracking and spalling to the coating. The low thermal conductivity and heat capacity of ceramics hampers their ability to rapidly distribute thermal loads and, therefore, local stresses generated during thermal cycling. As a result of these factors, ceramic coatings have not been successfully used on components in liquid sodium environments. Because of their poor impact strength, ceramics and, in particular, ceramic coatings are also susceptible to mechanical damage which causes cracking and spalling of the coating rendering it unprotective.

Cermet material applied as coatings have shown promise in solving friction and wear problems in sodium systems. Cermets are at least a two phase system composed of predominantly a ceramic component with a metallic component (binder). The volume fraction of the metallic component can be adjusted to enhance the properties of the cermets. Cermets by their very nature possess improved thermal shock resistance compared to ceramics. The presence of the metallic phase also significantly improves the impact strength while preserving most of the wear resistance of the ceramic. One such system, which has demonstrated the ability of a cermet coating to reduce friction and wear of sliding components in high temperature sodium, is a $Cr_3C_2$ plus 15 vol percent nickel chromium coating applied using the detonation gun technique. Table 1 compares the friction and wear characteristics of both plasma-deposited and detonation gun $Cr_3C_2$ plus nickel chromium coatings on 316 stainless steel with uncoated 316 stainless steel in self-mating wear. The designation 316 stainless steel is an American Iron and Steel Institute designation for a stainless steel which nominally contains about 16– 18 wt % chromium; 10–14 wt % nickel; 2 wt % manganese; 2–3 wt % molybdenum; 1 wt % silicon; and .08 carbon balance iron.

Table 1 shows three friction coefficients. The static friction coefficient is that observed at the moment of impending motion. The dynamic friction coefficient is that observed after motion has begun. The break away friction coefficient is defined in much the same way as the static friction coefficient except that it is usually a function of time. Table 1 also shows that the plasma-deposited $Cr_3C_2$ plus nickel chromium coating is not as thermal shock resistant and suffers from irradiation damage; however, the friction and wear properties are very good suggesting that this coating may still be useful in a sodium system in areas where thermal cycling or irradiation effects are negligible or non existent.

Table 1

| | Uncoated 316 S.S. | $Cr_3C_2$ plus Nickel Chromium Coated 316 S.S. D-Gun | $Cr_3C_2$ plus Nickel Chromium Coated 316 S.S. Plasma |
|---|---|---|---|
| Corrosion Rate mils/yr | .2 | .15 | .15 |

Table 1-continued

| | Uncoated 316 S.S. | $Cr_3C_2$ plus Nickel Chromium Coated 316 S.S. D-Gun | $Cr_3C_2$ plus Nickel Chromium Coated 316 S.S. Plasma |
|---|---|---|---|
| Friction Coefficient Static | >1 | .39 | .39 |
| Friction Coefficient Dynamic | .8 | .36 | .36 |
| Friction Coefficient Break-away | >1 | .64 | .64 |
| Wear Rate | high | negligible | negligible |
| No. of Thermal Cycles to Failure | N/A* | >60 | <60 |
| Irradiation Effects - Total Fluence to Failure | | $>3\times10^{22}$neutron/cm$^2$ | $1\times10^{22}$neutron/cm$^2$ |

>means greater than, <means less than. *N/A = not applicable.

The friction, wear, and corrosion values of $Cr_3C_2$ plus nickel chromium coated 316 stainless steel shown in Table 1 are quite adequate for most current reactor designs. For new, more advanced reactors improved coatings are required. In particular, coatings which have lower friction coefficients are a necessity.

This invention is based on the discovery that a combination of a cermet layer with a thin overlay of pure chromium carbide provides excellent friction and wear properties and, with suitable adjustments in the thickness of the chromium carbide overlayer within a given range, excellent thermal shock and mechanical strength of the coating can be maintained. While there exist numerous methods for achieving this type of structure, the most practical way is to deposit a duplex coating consisting of two distinct layers.

A preferred system of the invention consists of an inner layer of cermet made from a powder mixture of $Cr_3C_2$ and a nickel 20 wt % chromium alloy and an outer layer made from a powder of $Cr_3C_2$. Consideration of all of the thermal, mechanical and wear factors indicates that the range of thickness of the two layers should be from 0.001 to 0.015 for the inner layer and from 0.0005 to 0.005 inches for the outer layer. The composition of the inner layer may vary from 10 wt % nickel-chromium alloy to 30 wt %. Similarly, some variation in the chromium content is allowable, consistent with its mechanical performance. It is well known that $Cr_3C_2$ when plasma or detonation gun deposited crystallizes as a mixture of the carbide phases, but in typical service in sodium cooled reactors the transformation to the thermodynamically stable state occurs very slowly over a long period of time and does not destroy the coating.

The superiority of the coatings of this invention was demonstrated by producing and testing a coating consisting of two layers. The first was a mixture of $Cr_3C_2$ plus 11 weight percent of an alloy of 80 percent nickel — 20 percent chromium deposited to a thickness of .003 inches to .004 inches by the detonation gun process on 316 stainless (containing 20% cold worked). A second layer was then deposited by the detonation gun process over the first layer which consisted of 100 percent $Cr_3C_2$ to a thickness of 0.0005 to 0.0015 inches. Test coupons coated in this manner were evaluated in liquid sodium at elevated temperature to measure the friction and wear properties. A summary of these results are shown in Table 2.

Table 2

| | Uncoated 316 S.S. | $Cr_3C_2$ plus Nickel Chromium Coated 316 S.S. D-Gun | $Cr_3C_2/Cr_3C_2$ plus Nickel Chromium Coated 316 S.S. D-Gun |
|---|---|---|---|
| Corrosion Rate mil/yr | .2 | .15 | <.15 |
| Friction Coefficient Static | >1 | .39 | .4 |
| Friction Coefficient Dynamic | .8 | .36 | .15 |
| Friction Coefficient Break-away | >1 | .64 | .4 |
| Wear Rate | high | negligible | negligible |
| No. of Thermal Cycles to Failure | | >60 | >60 |
| Irradiation Effects | | $>3\times10^{22}$ neutron/cm$^2$ | not available |

The superior performance of the coating of this invention relative to the cermet coatings in Table 1 is apparent. It is thought that the higher coefficients of friction of the cermets is due to the metal-to-metal contact of the binder phase, even though this accounts for only a small percentage of the exposed surface area. Since there is no metallic phase at the surface in the coatings of this invention, there is no metal-to-metal contact and low coefficients of friction are achieved.

Thermal shock resistance and mechanical impact resistance are surprisingly high, due to the graduation in properties from the metallic sustrate to the cermet, to the pure oxide.

An additional attribute of the coatings of this invention is the inherent safety factor arising from the presence of an undercoat with good, if not superior, wear and friction characteristics. Thus, if through mishandling during assembly any mechanical damage to the ceramic outer layer does occur, the cermet underlayer will prevent complete seizure or excessive frictional drag.

Another preferred system of the invention includes an inner layer of $Cr_{23}C_6$ plus nickel chromium with a surface layer of pure $Cr_{23}C_6$. It has been discovered that $Cr_{23}C_6$, the softest of the chromium carbides, can be mixed with nickel-chromoum binder to produce a plasma or detonation gun coating having extremely long life. See copending application Ser. No. 545,832 filed Jan. 31, 1975. such coating compositions have long term thermodynamic stability which is critical due to the anticipated long service life of nuclear reactor components. A preferred composition for the inner layer is 70–95 wt % $Cr_{23}C_6$ the balance being a binder of nickel—chromium, cobalt—chromium, iron—-chromium or a superalloy.

Other systems within the scope of this invention would include a duplex system composed of a $Cr_3C_2$ plus nickel-chromium layer with an overlay of $Cr_7C_3$ or $Cr_{23}C_6$ or a mixture of $Cr_3C_2$, $Cr_7C_3$ and $Cr_{23}C_6$. Another system would include a $Cr_{23}C_6$ plus nickel-chromium layer with an overlay of $Cr_3C_2$ or mixtures of $Cr_3C_2$, $Cr_7C_3$ and $Cr_{23}C_6$.

While the preferred system consists of a duplex system of two distinct layers, it is possible to utilize a gradated system of more than two layers or a continuously increasing carbide content from the substrate to the pure chromium carbide outlayer.

While all of the data above was developed using 316 stainless steel substrates, it is readily apparent that structural components of other metal alloys can be equally well protected. For example, the nickel—-chromium binder or an Inconel 718 binder would work well on Inconel 718 substrates. Inconel 718 is a nickel base superalloy and nominally contains nickel; 18.6 wt % chromium; 3.1 wt % molybdenum; 5.0 wt % niobium; 18.5 wt % iron; 0.9 wt % titanium; 0.4 wt % aluminum; 0.04 wt % carbon; 0.20 wt % manganese; and 0.30 wt % silicon.

All of the above description has been directed to sodium-cooled reactors; however, there are other systems in which the coatings of this invention may be particularly useful. One of these is helium-cooled reactors in which the helium gas is actually reducing to most metal oxides so similar metal-to-metal friction and wear problems exist.

Having described the invention with respect to certain preferred embodiments it should be understood that certain modifications can be made to structures described herein without departing from the spirit and scope of this invention.

What is claimed is:

1. A coated structure consisting of a metallic substrate taken from the class of metals consisting of nickel-base and iron-base alloys; a first layer on said substrate consisting of chromium carbides and a binder taken from the class consisting of nickel-chromium, cobalt-chromium, iron-chromium, and superalloys, said first layer being from 0.001 to 0.015 inches thick, and a surface layer consisting of pure chromium carbides said surface layer being from 0.0005 to 0.005 inches thick.

2. A coated structure according to claim 1 wherein the substrate is 316 stainless steel, the first layer is made from a powder consisting of 70 to 90 wt % $Cr_3C_2$ and 10 to 30 wt % nickel-chromium and the surface layer is made from a powder consisting of essentially pure $Cr_3C_2$.

3. A coated structure according to claim 1 wherein the substrate is 316 stainless steel the first layer is made from a powder consisting of from 70 to 95 wt % $Cr_{23}C_6$, the balance nickel-chromium and the surface layer is made from a powder consisting essentially of pure $Cr_{23}C_6$.

4. A coated structure according to claim 1 wherein the substrate is 316 stainless steel, the first layer is made from a powder consisting of 87 wt % $Cr_3C_2$ and 11 wt % nickel-chromium and has a thickness of from .003 to .004 inches and the surface layer is made from a powder consisting essentially of $Cr_3C_2$ having a thickness of from 0.0005 to 0.0015 inches.

5. A coated structure consisting of a metallic substrate taken from the class of metals consisting of nickel-base and iron-base alloys; a coating on said substrate consisting of chromium carbides and a binder taken from the class consisting of nickel-chromium, cobalt-chromium, iron-chromium and superalloys, the percentage of binder in said coating decreasing form the surface of said substrate until the outer surface of the coating is pure chromium carbides.

6. A coated structure according to claim 2 wherein the powder is deposited by a plasma deposition or detonation gun process.

7. A coated structure according to claim 3 wherein the powder is deposited by a plasma deposition or detonation gun process.

8. A coated structure according to claim 4 wherein the powder is deposited by a plasma deposition or detonation gun process.

* * * * *